US007283094B2

(12) United States Patent
Lee

(10) Patent No.: US 7,283,094 B2
(45) Date of Patent: Oct. 16, 2007

(54) DUAL BAND ANTENNA ASSEMBLY AND METHOD FOR DESIGNING THE SAME

(75) Inventor: Ming-Chou Lee, Hsin Tien (TW)

(73) Assignee: Airoha Technology Corp., Hsinchu (TW)

( * ) Notice: Subject to any disclaimer, the term of this patent is extended or adjusted under 35 U.S.C. 154(b) by 64 days.

(21) Appl. No.: 11/301,871

(22) Filed: Dec. 13, 2005

(65) Prior Publication Data

US 2006/0132361 A1 Jun. 22, 2006

(30) Foreign Application Priority Data

Dec. 17, 2004 (TW) ..... 93139517 A

(51) Int. Cl.
*H01Q 1/38* (2006.01)

(52) U.S. Cl. ..... 343/700 MS; 343/702

(58) Field of Classification Search ..... 343/700 MS, 343/846, 895, 702
See application file for complete search history.

(56) References Cited

U.S. PATENT DOCUMENTS 6,856,294 B2 * 2/2005 Kadambi et al. ..... 343/702
6,933,902 B2 * 8/2005 Yeh ..... 343/762
2005/0007279 A1 * 1/2005 Chang ..... 343/700 MS

* cited by examiner

*Primary Examiner*—Hoang V. Nguyen
(74) *Attorney, Agent, or Firm*—Ladas & Parry LLP

(57) ABSTRACT

A dual band antenna assembly includes a radiating metal strip fabricated on a baseboard. The radiating metal strip includes a winding strip section having a heading end and a tail end, a connected strip section having one connecting end coupled integrally to the tail end of the winding strip section and the other connecting end, a lump-like strip section having a first terminal end serving as a feeding pin and a second terminal end coupled integrally to the other connecting end of the connected strip section. A first signal-working band is defined when a current path flows through the feeding pin and the second terminal end of the lump-like strip section to generate a first resonance. A second signal-working band is defined when a current path flows through the lump-like strip section, the connected strip section and the winding strip section to generate a second resonance.

21 Claims, 6 Drawing Sheets

DUAL BAND ANTENNA ASSEMBLY AND METHOD FOR DESIGNING THE SAME

FIELD OF THE INVENTION

The present invention relates to an antenna assembly, more particularly to a dual band antenna assembly and the method for designing the same.

BACKGROUND OF THE INVENTION

A network card (WLAN card) is used in a computer for mass transmission of data within a network (such as standard LAN protocol) so as to eradicate the problem of forming complicated wired cables (line connection) for coupling pluralities of computers together in the network. In fact, in a WLAN, antenna devices replace the wired cables with the assistance of the network card for conducting data transmission. A monopole antenna assembly has a compact size and can be formed on a printed circuit board by screen-printing technology. Due to its compact size and lightness in weight, the monopole antenna assembly is employed in a wireless communication product (such a cellular phone) for signal transmission.

FIG. 1 shows a conventional monopole antenna assembly to include a baseboard 10, a grounding metal layer 12, and a radiating metal strip 14. The radiating metal strip 14 is mounted on the upper surface of the baseboard 10 by the screen printing technology, and includes a feeding strip section 16 with a feeding pin 18 for coupling to a matching circuit (not shown). The grounding metal layer 14 is mounted on the lower surface of the baseboard 10, and is spaced apart from the feeding pin 18 by a quarter wavelength of the intended transmission frequency band.

It is noted that the dimension of the radiating metal strip 14 cannot be reduced further since it is generally limited to be within the range of the quarter wavelength of the transmission frequency band. However, the passivation components on the integrated circuit are in the trend to reduce the size, limitation of the monopole antenna assembly within the quarter wavelength blocks the research for reducing the dimension of the conventional antenna assembly.

In addition, the aforesaid monopole antenna assembly is only compatible with a single channel, such as a wireless local area network. The operating band is ISM 2.4 GHz, which is presently assigned to Industrial Scientific Medical band. Since the use of wireless technology (like Bluetooth) is more and more common day-by-day, the telecommunication apparatuses may suffer co-channel interference or next-channel interference. Moreover, the high frequency bandwidth ranging 8-9 GHz is not compatible with the presently available protocols and is not allowed for commercial use today. The larger the size of the radiating metal strip, relative to the operating wavelength, the greater antennas gain, i.e. large, flatter conductors have less resistive lose due to their large area surface. However, it is absolutely impossible to design large antenna assembly within the telecommunication apparatuses.

SUMMARY OF THE INVENTION

The object of the present invention is to provide a dual band antenna assembly of a built-in type so as to adjust the high transmission frequency to overcome the disadvantage of the conventional monopole antenna assembly.

In one aspect of the present invention, a dual band antenna assembly is provided to include: a baseboard having an insulating part defined on an upper surface the baseboard; and a radiating metal strip fabricated on the insulating part in the upper surface of the baseboard, and including a winding strip section having a heading end and a tail end, a connected strip section having one connecting end coupled integrally to the tail end of the winding strip section and the other connecting end, a lump-like strip section having a first terminal end serving as a feeding pin and a second terminal end coupled integrally to the other connecting end of the connected strip section. A first signal-working band is defined when a current path flows through the feeding pin and the second terminal end of the lump-like strip section to generate a first resonance. A second signal-working band is defined when a current path flows through the lump-like strip section, the connected strip section and the winding strip section to generate a second resonance.

In another aspect of the present invention, a method for designing a dual band antenna assembly is provided to include: (a) providing a baseboard; (b) fabricating a lump-like strip section on the baseboard, the lump-like strip section having a first terminal end serving as a feeding pin and a second terminal end, wherein a first resonant path generated due to flow of current through the feeding pin and the second terminal end is defined according to a quarter wavelength of a signal within a first signal-working band for the dual band antenna assembly; (c) fabricating a connected strip section on the baseboard 30, the connected strip section having one connecting end coupled integrally to the second terminal end of the lump-like strip section and the other connecting end; and (d) fabricating a winding strip section on the baseboard, the winding strip section having a heading end and a tail end coupled integrally to the other connecting end of the connected strip section. The winding strip section, the connected strip section and the lump-like strip section cooperatively define a radiating metal strip for the dual band antenna assembly such that a second resonant path generated due to flow of current through the lump-like strip section, the connected strip section and the winding strip section is defined according to a quarter wavelength of a signal within a second signal-working band for the dual band antenna assembly.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENTS

Figure 1:
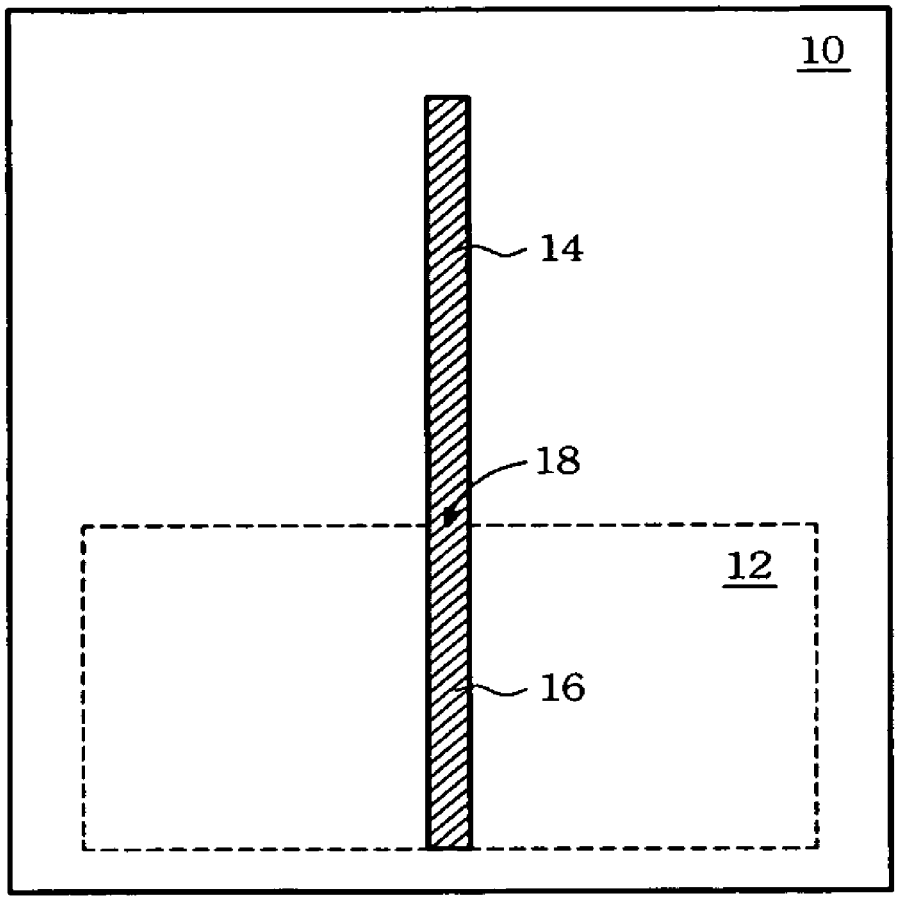
Fig. 1 (Prior Art)
FIG. 1 is a top planar view, illustrating a conventional monopole antenna assembly.
Figure 2A:
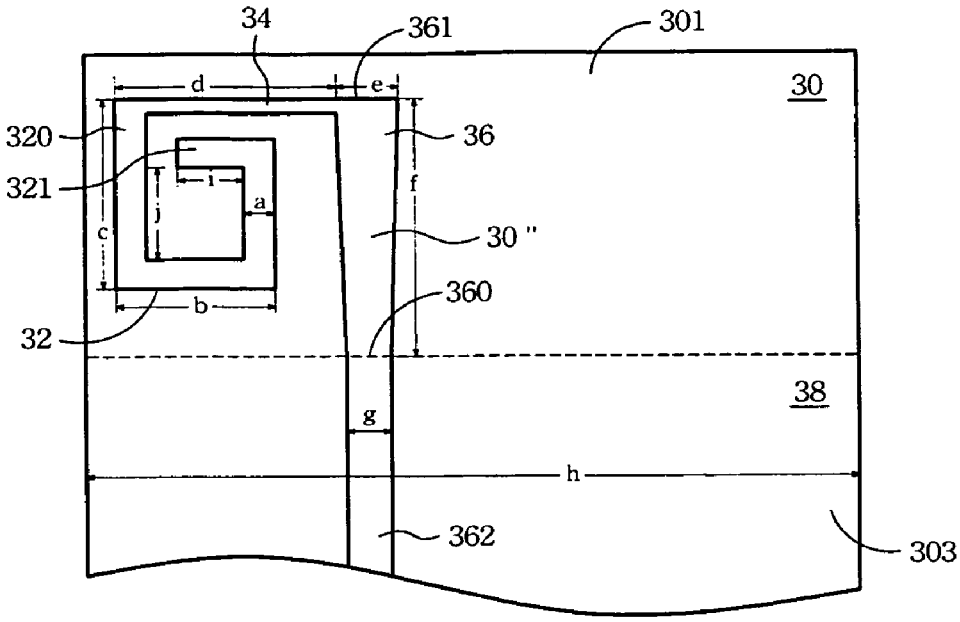
FIGS. 2A to 2F show different configurations of the first embodiment of a dual band antenna assembly according to the present invention.

Referring to FIG. 2A, a fragmentary top planar view of the first embodiment of a dual band antenna assembly according to the present invention is shown to include a baseboard 30, a radiating metal strip 30", and a grounding metal layer (not visible in FIG. 2A). The baseboard 30 preferably includes a plurality of layers.

The baseboard 30 has opposite upper and lower surfaces each of which defines an insulating part 301 and a grounding part 302.

The radiating metal strip 30" is fabricated on one layer of the baseboard 30 (not shown). In FIG. 2A, the radiating metal strip 30" is fabricated in the insulating part 301 on the upper surface of the baseboard 30, and includes a winding strip section 32, a connected strip section 34 and a lump-like strip section 36.

Figure 2B:
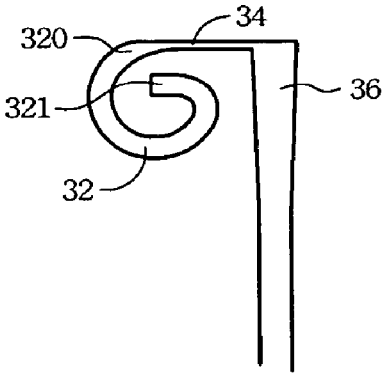
Figure 2C:
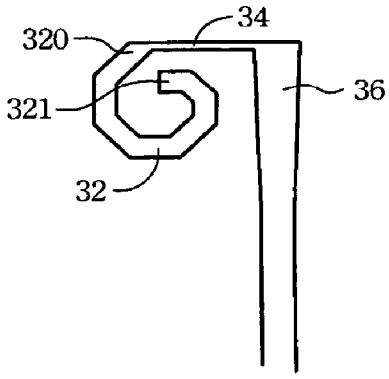
Figure 2D:
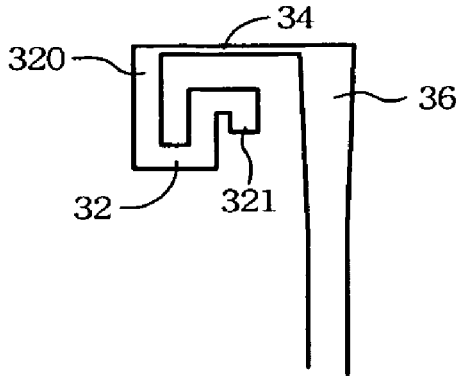
Figure 2E:
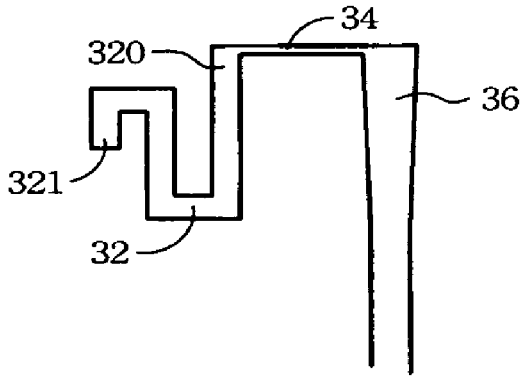

The winding strip section 32 has a heading end 321 and a tail end 320. As shown in FIGS. 2B and 2C, the winding strip section 32 of the first embodiment has a helical configuration, or a wavelength configuration as best shown in FIGS. 2D and 2E. The sole motive of forming different configurations is to minimize the occupying space of the total length of the winding strip section 32 on the baseboard 30. Several other configurations of the winding strip section 32 should encompass the scope and spirit of the present invention.

Figure 2F:
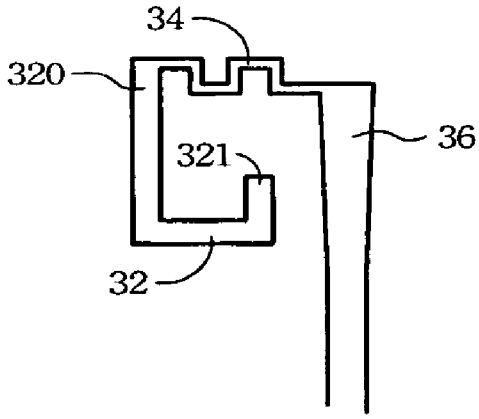

The connected strip section 34 has one connecting end coupled integrally to the tail end 320 of the winding strip section 32 and the other connecting end. Note that the connecting strip section 34 has a higher impedance when compared to the lump-like strip section 36, a width 0.255 mm that is smaller than that of the winding strip section 32 (see FIGS. 2A to 2E). As shown in FIG. 2F, the connecting strip section 34 is meandering-shaped such that when the dual band antenna assembly of the present invention under operation in the first signal-working band, an effective current flow path caused thereby permits neglect of longitudinal length of the winding strip section 32. Under high frequency, the connecting strip section 34 can be regarded as an inductor such that the effective current flow path becomes short.

The lump-like strip section 36 has a first terminal end 360 serving as a feeding pin for connecting to a signal processing module (not shown) via a feeding strip section 362 (see FIG. 4) and a second terminal end 361 coupled integrally to the other connecting end of the connected strip section 34. Preferably, the feeding pin 360 of the lump-like strip section 36 is fabricated on the baseboard 30 at a position adjoining the insulating and grounding parts 301, 302. The grounding metal layer (not visible in FIG. 2A) is fabricated on the grounding part in the lower surface of the baseboard and is spaced apart from the feeding pin of the lump-like strip section 36. When the radiating metal strip 30" is under high frequency transmission, since the connected strip section 34 serves the inductor, the current flow path generated due to the first resonance can be limited within the lump-like strip section 36 in order to increase the high frequency bandwidth.

Figure 3A:
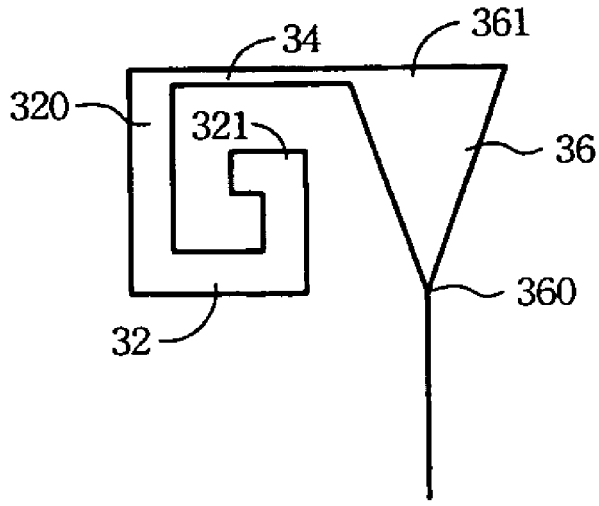
FIGS. 3A and 3B show two lump-like strip sections employed in the first embodiment of the dual band antenna assembly according to the present invention.
Figure 3B:
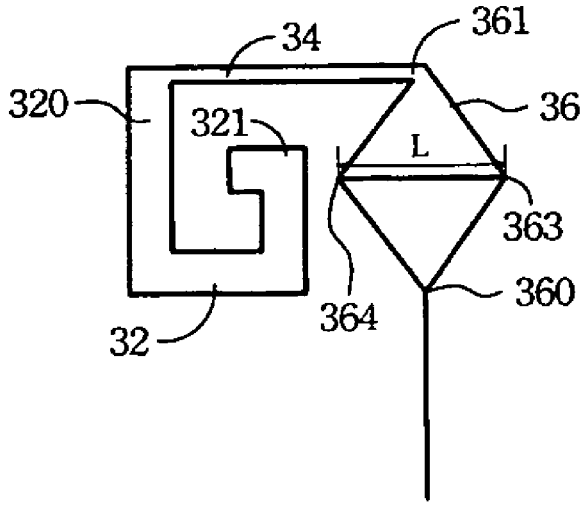
Figure 4:
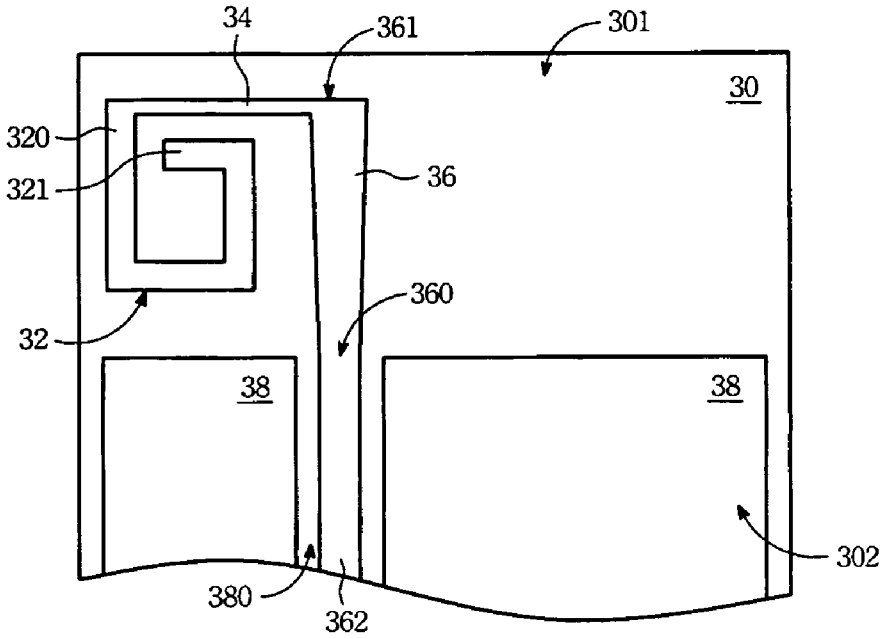
FIG. 4 shows the second embodiment of the dual band antenna assembly according to the present invention.

Referring again to FIG. 2A, the lump-like strip section 36 has a generally a trapezoid-shaped configuration such that the second terminal end 361 has a width greater than that of the first terminal end 360. In addition, as shown in FIG. 3A and 3B, the lump-like strip section 36 is shaped as a triangle or a rhombus having two opposite ends respectively defining the second and first terminal ends 361, 360 of the lump-like strip section 36. The object of forming the lump-like strip section 36 in the radiating metal strip 30" is to enhance the current flow path during the data transmission under high frequency band. Alternately, as shown in FIG. 4, the grounding metal layer 38 is fabricated in the grounding part 302 on the upper surface of the baseboard 30, and defines a feeding structure 380 that is spaced apart from the feeding pin of the lump-like strip section 36. Thus, a (CPWG) co-planar wave guide is established.

Under this condition, a first signal-working band is defined when a current path flows through the feeding pin and the second terminal end 361 of the lump-like strip section 36 to generate a first resonance. A second signal-working band is defined when a current path flows through the radiating metal strip 30" (i.e. the lump-like strip section 36, the connected strip section 34 and the winding strip section 32) to generate a second resonance. In the first embodiment, the first signal-working band has a higher frequency when compared to the second signal-working band.

Figure 5:
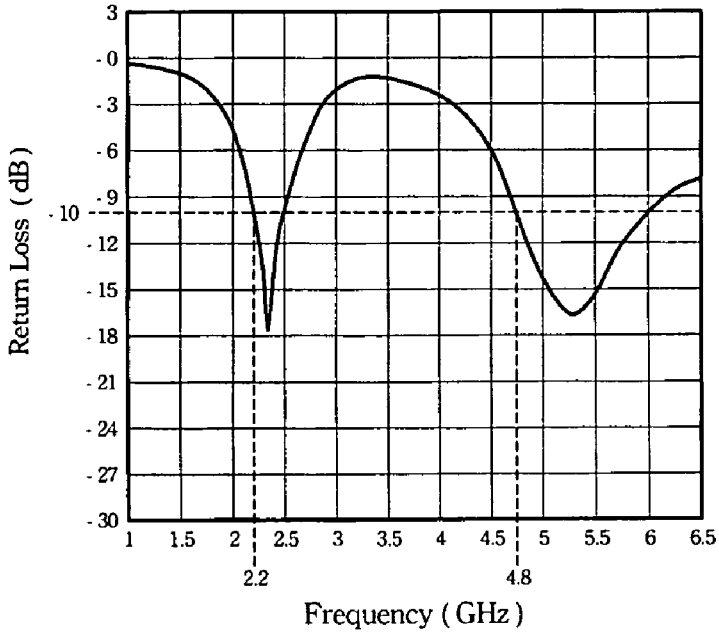
FIG. 5 illustrates a diagram for computer stimulation result of the first embodiment, when the lower end of the lump-like strip section has a 2 mm width.

FIG. 5 is a diagram of the computer stimulation results, illustrating the input return loss verses frequency for the dual band antenna assembly of the present invention (see FIG. 2A), wherein a=1 mm, b=5.1 mm, c=5.4 mm, d=7.1 mm, e=2 mm, f=8.2 mm, g=1.45 mm, h=46.7 mm, i=2.1 mm and j=3.2 mm. As shown in the diagram the first signal-working band ranges 4.8 GHz to 6 GHz (i.e. the bandwidth is 1.2 GHz) while the second signal-working band ranges 2.2 GHz to 2.5 GHz. In case, the present dual band antenna assembly is employed in the WLAN, it is compatible with IEEE802.11b/g and 802.11a protocols.

Figure 6:
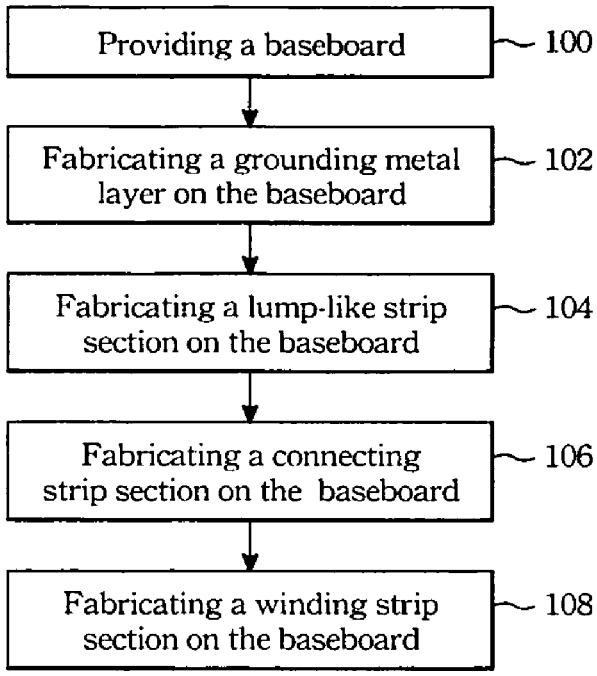
FIG. 6 is a block diagram, illustrating the steps of designing the dual band antenna assembly of the present invention.

FIG. 6 is a block diagram, illustrating the steps of designing a dual band antenna assembly of the present invention. As a matter of fact, the radiating metal strip is fabricated on the baseboard by screen-printing technology. According to the step 100, a baseboard 30 is provided. According to the step 102, a grounding metal layer 38 is fabricated on the baseboard 30. In this embodiment, the grounding metal layer 38 is fabricated on the same side as the radiating metal strip. Alternately, the grounding metal layer 38 is fabricated on the baseboard 30 opposite to the radiating metal strip. Then, a lump-like strip section 36 is fabricated on the baseboard 30 according to the step 104 in such a manner that the lump-like strip section 36 has a first terminal end 360 serving as a feeding pin for connecting to the signal processing module and a second terminal end 361, wherein a first resonant path generated due to flow of current through the feeding pin and the second terminal end is defined according to a quarter wavelength of a signal within a first signal-working band for the dual band antenna assembly.

Afterward, a connected strip section 34 is fabricated on the baseboard 30 according to the step 106 such that the connected strip section 34 has one connecting end coupled integrally to the second terminal end 361 of the lump-like strip section 36. Finally, according to the step 108, a winding strip section 32 is fabricated on the baseboard 30 such that the winding strip section 32 has a heading end 321 and a tail end 320 coupled integrally to the other connecting end of the connected strip section 34. The winding strip section 32, the connected strip section 34 and the lump-like strip section 36 cooperatively define the radiating metal strip for the dual band antenna assembly such that a second resonant path generated due to flow of current through the lump-like strip section 36, the connected strip section 34 and the winding strip section is defined according to a quarter wavelength of a signal within a second signal-working band for the dual band antenna assembly. Preferably, the lump-like strip section 36 is shaped as a triangle (see FIG. 3A) such that the width of the second terminal end 361 of the inverted triangle 36 can be adjusted in order to achieve a predetermined frequency range for the first signal-working band. Alternately, the lump-like strip section 36 is shaped like a rhombus (see FIG. 3B) having two opposite ends respectively defining the second and first terminal ends 360, 361. By adjusting a distance "L" between two opposite ends 363, 364 of the rhombus 36 adjacent to the second terminal end 361 in order to achieve a predetermined frequency range for the first signal-working band.

Figure 7:
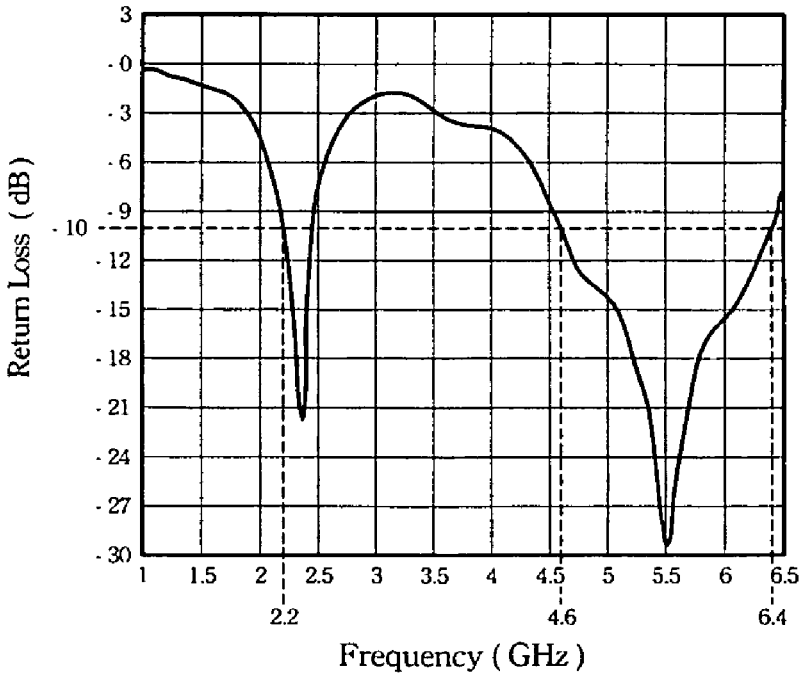
FIG. 7 illustrates a diagram for computer stimulation result of the first embodiment, when the lower end of the lump-like strip section has a 3.55 mm width.

FIG. 7 is a diagram of the computer stimulation results, illustrating the input return loss verses frequency for the dual band antenna assembly of the present invention (see FIG. 2A), wherein the width "e" of the second terminal end 361 of the lump-like strip section 36 is increased to 3.55 mm from 2 mm. From the aforesaid diagram, it can be observed that the signal-working band is increased from 1.2 GHz to 1.8 ghz (when the return loss −10 dB, the signal-working band is 4.6 Ghz-6.46 GHz).

In summary, the dual band antenna assembly of the present invention provides the following advantages over the conventional techniques:

(1) The dual band antenna assembly occupies a smaller layout area when compared to the conventional monopole antenna assembly. It is in the trend to reduce the dimension of the antenna assembly, hence the wireless telecommunication apparatus.

(2) The dual signal-working bands provide a more flexible designing range during the manufacture of a wireless communication product.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A dual band antenna assembly comprising:

a baseboard having a first insulating part defined on an upper surface of said baseboard; and a winding strip section formed in said insulating part and having a heading end and a tail end;

a connected strip section formed in said insulating part and having one connecting end coupled integrally to said tail end of said winding strip section;

a lump-like strip section formed in said insulating part and having a first terminal end serving as a feeding pin and a second terminal end coupled integrally to the other connecting end of said connected strip section;

wherein, a first signal-working band is defined when a first current path flows through said feeding pin and said second terminal end of said lump-like strip section to generate a first resonance, and a second signal-working band is defined when a second current path flows through said lump-like strip section, said first signal-working band being higher than said second signal-working band, said connected strip section and said winding strip section to generate a second resonance.

2. The dual band antenna assembly according to claim 1, wherein said baseboard has a lower surface that defines a second insulating part and a grounding part.

3. The dual band antenna assembly according to claim 2, further comprising a grounding metal layer fabricated in said grounding part on said lower surface of said baseboard.

4. The dual band antenna assembly according to claim 1, wherein said upper surface of said baseboard further defines a grounding part.

5. The dual band antenna assembly according to claim 4, further comprising a grounding metal layer fabricated in said grounding part on said upper surface of said baseboard and being spaced apart from said feeding pin of said lump-like strip section.

6. The dual band antenna assembly according to claim 1, wherein said winding strip section is a helical configuration, a wavelength configuration or a combination of both.

7. The dual band antenna assembly according to claim 1, wherein said connected strip section has a width smaller than that of said winding strip section.

8. The dual band antenna assembly according to claim 1, wherein said connecting strip section connecting strip section is meandering-shaped such that when the dual band antenna assembly is in operation under said first signal-working band, an effective current flow path caused thereby permits neglect of longitudinal length of said winding strip section.

9. The dual band antenna assembly according to claim 1, wherein said connected strip section has an impedance greater than that of said lump-like strip section.

10. The dual band according to claim 1, wherein said second terminal end of said lump-like strip section has a width greater than that of said first terminal end of said lump-like strip section.

11. A method for designing a dual band antenna assembly, comprising the steps of:

providing a baseboard;

fabricating a lump-like strip section on said baseboard, said lump-like strip section having a first terminal end serving as a feeding pin and a second terminal end, wherein a first resonant path generated due to flow of current through said feeding pin and said second terminal end is defined according to a quarter wavelength of a signal within a first signal-working band for said dual band antenna assembly;

fabricating a connected strip section on said baseboard, said connected strip section having one connecting end coupled integrally to said second terminal end of said lump-like strip section;

fabricating a winding strip section on said baseboard, said winding strip section having a heading end and a tail end coupled integrally to the other connecting end of said connected strip section; and wherein, said winding strip section, said connected strip section and said lump-like strip section cooperatively define a radiating metal strip for said dual band antenna assembly such that a second resonant path generated due to flow of current through said lump-like strip section, said connected strip section and said winding strip section is defined according to a quarter wavelength of a signal within a second signal-working band for said dual band antenna assembly, said first signal-working band being higher than said second signal-working band.

12. The method according to claim 11, wherein said baseboard has an upper surface defining an insulating part and a grounding part, said lump-like strip section, said connected strip section and said winding strip section being fabricated in said insulating part on said upper surface of said baseboard, said feeding pin of said lump-like strip section being fabricated on said baseboard at a position adjoining said insulating and grounding parts.

13. The method according to claim 12, further comprising a step: forming a grounding metal layer on said grounding part in said upper surface of said baseboard, said grounding metal layer being spaced apart from said feeding pin of said lump-like strip section.

14. The method according to claim 11, wherein said baseboard has a lower surface that defines an insulating part and a grounding part.

15. The method according to claim 14, further comprising a step: forming a grounding metal layer in said grounding part on said lower surface of said baseboard.

16. The method according to claim 11, wherein said lump-like strip section has a trapezoid-shaped configuration such that said second terminal end of said lump-like strip section has a width greater than that of said first terminal end of said lump-like strip section.

17. The method according to claim 16, further comprising a step: adjusting a width of said second terminal end of said lump-like strip section in order to achieve a predetermined frequency range for said first signal-working band.

18. The method according to claim 11, wherein said lump-like strip section is shaped as a triangle and has a second terminal.

19. The method according to claim 18, further comprising a step: adjusting a width of said second terminal end of said lump-like strip section in order to achieve a predetermined frequency range for said first signal-working band.

20. The method according to claim 11, wherein said lump-like strip section is shaped like a rhombus having two opposite ends respectively defining said second and first terminal ends.

21. The method according to claim 11, further comprising a step: adjusting a distance between two opposite ends of said rhombus adjacent to said second terminal end in order to achieve a predetermined frequency range for said first signal-working band.

* * * * *